US010466023B2

(12) United States Patent
Garst et al.

(10) Patent No.: US 10,466,023 B2
(45) Date of Patent: Nov. 5, 2019

(54) LONG RANGE LARGE CALIBER FRANGIBLE ROUND FOR DEFENDING AGAINST UAV'S

(71) Applicant: Ascendance International, LLC, Highlands Ranch, CO (US)

(72) Inventors: Joseph Garst, Highlands Ranch, CO (US); Robert Folaron, Colorado Springs, CO (US)

(73) Assignee: Ascendance International, LLC, Highlands Ranch, CO (US)

( * ) Notice: Subject to any disclaimer, the term of this patent is extended or adjusted under 35 U.S.C. 154(b) by 0 days.

(21) Appl. No.: 16/367,881

(22) Filed: Mar. 28, 2019

(65) Prior Publication Data

US 2019/0301844 A1 Oct. 3, 2019

Related U.S. Application Data

(60) Provisional application No. 62/649,447, filed on Mar. 28, 2018, provisional application No. 62/716,341, filed on Aug. 8, 2018.

(51) Int. Cl.

| | |
|---|---|
| ***F42B 7/00*** | (2006.01) |
| ***F42B 10/16*** | (2006.01) |
| ***F42B 7/08*** | (2006.01) |
| ***F42B 7/04*** | (2006.01) |

(52) U.S. Cl.

CPC ..... *F42B 10/16* (2013.01); *F42B 7/046* (2013.01); *F42B 7/08* (2013.01)

(58) Field of Classification Search

CPC .... F42B 7/02; F42B 7/04; F42B 7/043; F42B 7/08; F42B 10/14; F42B 10/143; F42B 10/16; F42B 10/18; F42B 10/20; F42B 12/56; F42B 12/58; F42B 12/62; F42B 12/64

See application file for complete search history.

(56) References Cited

U.S. PATENT DOCUMENTS

| | | | | |
|---|---|---|---|---|
| 3,565,010 A * | 2/1971 | Sahlmann | F42B 7/08 102/453 |
| 3,703,866 A | 11/1972 | Eugene | |
| 4,005,631 A | 2/1977 | Kaiser et al. | |
| 4,682,546 A * | 7/1987 | Chovich | F42B 8/14 102/501 |
| 5,936,189 A | 8/1999 | Lubbers | |
| 6,138,547 A | 10/2000 | Larsson et al. | |
| 6,170,377 B1 | 1/2001 | Larsson et al. | |

(Continued)

OTHER PUBLICATIONS

DroneDefender®; C-UAS Device [online]. Battelle Memorial Institute, 2018. [Retrieved on Apr. 27, 2018]. Retrieved from internet: https://www.battelle.org/government-offerings/national-security/aerospace-systems/counter-UAS-technologies/dronedefender.

(Continued)

*Primary Examiner* — Gabriel J. Klein
(74) *Attorney, Agent, or Firm* — VOZ Patents, LLC

(57) ABSTRACT

The present invention is directed to a projectile configured to provide a submunition payload across a wide impact pattern, similar to that of a shotgun, at a range typically beyond the capability of standard shotgun rounds. The additional range is provided in some embodiments of the invention by allowing the tailoring deployment range of the submunition payload based upon a given threat.

17 Claims, 15 Drawing Sheets

(56) References Cited

U.S. PATENT DOCUMENTS

| | | | | |
|---|---|---|---|---|
| 6,260,484 | B1 * | 7/2001 | Billings | F42B 7/08 102/453 |
| 6,626,077 | B1 | 9/2003 | Gilbert | |
| 6,988,450 | B1 * | 1/2006 | Georgantzis | F42B 5/08 102/401 |
| 9,068,807 | B1 * | 6/2015 | Thomas | F42B 15/10 |
| 9,115,965 | B2 | 8/2015 | Alculumbre | |
| 9,879,957 | B2 | 1/2018 | Moser et al. | |
| 9,896,221 | B1 | 2/2018 | Kilian et al. | |
| 2013/0042783 | A1 * | 2/2013 | Diller | F42B 7/04 102/513 |
| 2016/0015499 | A1 * | 1/2016 | Scott | F42B 7/08 604/130 |

OTHER PUBLICATIONS

DroneGun MKII; Highly Effective, Long Rangel drone Countermeasure; [online]. Droneshield, 2017. [Retrieved on Apr. 27, 2018]. Retrieved from internet: https://www.droneshield.com/dronegun/.

DroneGun Tactical; Highly Effective, Portable Drone Countermeasure; [online]. Droneshield, 2017. [Retrieved on Apr. 27, 2018]. Retrieved from internet: https://www.droneshield.com/dronegun-tactical/.

Nammo 40mm Airburst Round; Nammo BulletIN, 2018 pp. 4-7; [online]. Nammo, 2018. [Retrieved on Apr. 27, 2018]. Retrieved from internet: www.nammo.com.

* cited by examiner

LONG RANGE LARGE CALIBER FRANGIBLE ROUND FOR DEFENDING AGAINST UAV'S

CROSS REFERENCE TO REFERENCE TO RELATED APPLICATIONS

This application claims the benefit of U.S. Provisional Patent Application 62/649,447 entitled "LONG RANGE LARGE CALIBER FRANGIBLE ROUND FOR DEFENDING AGAINST UAVS" filed on Mar. 28, 2018; and U.S. Provisional Patent Application 62/716,341 entitled "LONG RANGE LARGE CALIBER FRANGIBLE ROUND FOR DEFENDING AGAINST UAV'S" filed on Aug. 8, 2018, the entire contents of which are incorporated herein by reference in its entirety for all purposes.

FIELD OF THE INVENTION

The present invention is directed to a 40 mm (1.57 in) projectile round configured to provide a large submunition payload across a wide impact pattern, similar to that of a shotgun, at a range typically beyond the capability of standard shotgun rounds. The present invention relates to long range shotgun shells and similar projectiles for the destruction of CLASS I and II commercial drones and other unmanned aerial vehicles.

BACKGROUND OF THE INVENTION

Unmanned Aerial Vehicles, such as CLASS I and II commercial Arial Drone Systems, herein referred to as drones, have become prevalent threats to privacy and safety in a wide variety of use cases. Until recently, the use of improvised explosive devices (IEDs) were responsible for approximately two-thirds of U.S. and Coalition casualties. Recent reports forecast that the use of weaponized drones will surpass the threat of IEDs in future conflicts. (Gouré, D. (2018, Feb. 8) [Retrieved from internet on 2018, Apr. 27] Drones will Surpass IED Threat in Future Conflicts. Retrieved from: <https://www.realcleardefense.com/articles/2018/02/08/drones_to_will_surpass_ied_threat_in_future_conflicts_113030.html>. Weaponization of drones, typically surrounds modifying a drone to allow it to carry and deliver lethal munitions. Weaponized drones have become increasingly common and pose a real and effective threat, particularly inside a range of 200 meters (656 feet) from a target.

Small commercial drones typically fly at altitudes below 200 meters (656 feet), and fly low and fast resulting in low exposure times. Thus, the neutralization of a drone threat is increasingly difficult as it requires detection and subsequent action. Common threat scenarios maximize the unique flight characteristics of the drones and the ability to fly low, in near proximity to the ground—whereas detection and identification of the drones is difficult.

Furthermore, the unauthorized use of drones has become problematic in environments such as search and rescue operations and emergency response efforts. For instance, reports of drones encroaching into airspace in the proximity of wildfires, pose a real threat to the operation of fire-fighting airplanes and helicopters. Airborne drones threaten the safety of crew aboard fire-fighting aircraft due to risk of collision, thereby grounding the fire-fighting aircraft until the drones are no longer encroaching in the airspace.

Due to the threat of weaponized drones, and the repeated impedance of emergency response operations there is a need for a solution for immobilizing drones with an effective range beyond the current capabilities presently available solutions.

SUMMARY OF THE INVENTION

Currently available solutions propose a variety of methods to immobilize a drone mid-flight. There is an identified need a portable solution for the immobilization of a drone which allows a user to—preferably at a range of 200 meters (656 feet) or more.

Many solutions have been proposed for the immobilization of a drone surrounding the use of jamming technologies, sometimes referred to as "directed energy". Jamming technologies surround the use of electromagnetic noise at radio frequencies that drones operate and transmit video at, at a power level high enough to drown out effective communication between a drone and its pilot. A problem with such solutions surrounds the effects that jamming technologies have on surrounding infrastructure which maintains safety systems. For instance, a jammer intended to immobilize a drone can have negative effects on GPS systems as well as air traffic control. (O'Donnell, Michael J. A.A.E. "To Airport Sponsor." 26 Oct. 2016. [Retrieved from internet on 2018, May 15] Retrieved from: <https://www.faa.gov/airports/airport safety/media/UAS-Counter-Measure-Testing-letter.pdf) Furthermore, such solutions may result in a drone armed with explosives continuing toward its target due to forward momentum and falling toward its intended target with an unexploded payload. Thus, the drone, even if immobilized, poses a potential threat. In some scenarios, a jammer may result in a drone initiating a "return to home" action, in which it returns toward the operator. Although in some scenarios it is advantageous to for the initiation of such an action to allow the tracking the operator of the drone, it also poses a risk. If a drone is forced to initiate a "return to home" operation, and the operator is not found, the operator may be able to reuse the drone for a subsequent action against a target.

The use of a jamming technology is only effective as long as the jamming technology is active and directed toward a drone which poses a threat. Because portable jammer technologies require battery power, and because they disrupt radio communications sometimes critical for safety measures, the operational lifespan of such technologies is impractical for perpetual use. Thus, a drone that poses a threat must be safely disposed of prior to ceasing jamming functions. As a result, measures must be taken to dispose of, or permanently immobilize a drone prior to ceasing jamming functions.

It is an aspect of certain embodiments of the present invention to mitigate unintended negative effects which solutions such as like jammers and directed energy weapons sometimes have in an urban environment. Through the use of a kinetic defeat strategy, involving the use of ballistic particles directed at a target, it will be appreciated that the nature of this invention allows it to be both as a countermeasure against mobile targets and static targets while mitigating the shortfalls associated with some directed energy solutions.

Solutions such as jammers require personnel to carry additional equipment. This is both costly and encumbers the personnel's mobility and ability to respond rapidly to a threat. It is an aspect of the present invention to provide effective countermeasures to immobilize and neutralize drone threats with equipment commonly carried by law enforcement and military personnel.

Certain solutions surround the use of a drone to counter a drone which poses a threat. Drones may be used in terror attacks in both military and civilian environments. For instance, U.S. Pat. No. 9,896,221 to Kilian ("Killian"), incorporated herein in its entirety for all purposes, is directed to a drone with a net designed to ensnare other drones. This countermeasure is both more expensive than a single anti-drone projectile of the present invention, and is limited to immobilizing a single opposing drone at a time.

In certain solutions, law enforcement and military personnel use traditional weapons such as a shotgun—to attempt to immobilize a drone which poses a threat. However, weapons carried by law enforcement and military personnel, such as shotguns, are decreasingly effective at immobilizing a drone beyond 40 meters (131 feet) due to range limitations. A typical characteristic of shotgun shot is an approximately 2.5 cm (1 inch) in diameter of shot pattern, per meter distance to the target. Thus, the effective impact area of shotgun shot at 40 meters (131 feet), would be expected to be 100 cm (40 in) in diameter. However, the larger the area of the effective impact area, the larger the spacing between shotgun shot. It will be appreciated that the effective impact area refers to the area encompassing the points of impact of all payload elements, such as shot pellets, against a planar object perpendicular to the trajectory of the payload. Thus, a drone beyond 40 meters may not be immobilized by on-target shotgun shot due to spacing between shot. A drone which is within 40 meters (131 feet) of a target, poses a real threat. For instance, a drone travelling at speed which is immobilized by a shotgun may still travel 40 meters (131 feet) or more before coming to rest on the ground. Thus, the use of a shotgun to eliminate a threat posed by a drone may be ineffective in preventing the drone from reaching its intended target. As a result, there is a need for a solution for immobilizing a drone with an effective impact area at a range over 40 meters (131 feet), and more preferably with at a range of 200 meters (656 feet) or more.

Traditional weapons which are effective at 200 meters (656 feet) or more, such as rifles, surround the use of singular projectiles that are typically less than 1.3 cm (0.5 in) in diameter. Singular projectiles are not ideal for efficient immobilization of a drone, because the effective impact area of a singular projectile is limited to the profile of the singular projectile.

It is an aspect of the present invention to provide a munitions round capable of having a suitable effective impact area at a range of 200 meters (656 feet).

Existing solutions such as those disclosed by U.S. Pat. No. 9,879,957 to Moser ("Moser"), incorporated herein in its entirety for all purposes, use simple fins and deployable wall segments to stabilize and slow portions of a round. Such solutions are insufficient, in both range and amount of shot delivered as related to immobilizing a drone. The fins and wall segments as disclosed by Moser are deployed immediately upon firing to stabilize the wad and induce drag on the wad, allowing the shot held within the wad to more effectively separate from the wad. In essence, the invention of Moser allows the adjustment of patterning as related to a 40-yard target. However, Moser does not improve the effective range of a shotgun round.

Technologies such as those disclosed by U.S. Pat. No. 5,936,189 to Lubbers ("Lubbers"), incorporated herein in its entirety for all purposes, discloses a general cartridge case which acts similarly to a shotgun shell which is used existing large caliber ammunition, such as the 40 mm (1.57 in) caliber utilized in this invention. The use of 40 mm (1.57 in) shotgun shells, such as the M576, is common in military and law enforcement applications. However, existing rounds are designed for defeating personnel a range of approximately 40 meters (131 feet).

Certain existing solutions surround the use of deployable fins for small arms to provide increased stability and accuracy for projectiles over long ranges. References such as U.S. Pat. No. 9,115,965 to Alculumbre ("Alucumbre"), incorporated herein in its entirety for all purposes, provides an example of a projectile utilizing this concept. However, Alucumbre is directed toward use with singular projectiles, such as 40 mm (1.57 in) grenades. Grenades are designed to spread fragments referred to as "flak." While flak has a level of effectiveness in application for anti-aircraft measures, the debris pattern of flak is unpredictable and results in a significant danger when used in densely populated areas or in close proximity to unintended targets.

With the rising threat of terrorist attacks using drones in urban environments, there is also a rising need for counter-drone systems which can be both fully effective against drones and non-damaging to civilians and civilian property in proximity to the drone threat. Lead shot maintains kinetic energy well beyond 40 meters (131 feet) from deployment, resulting in a possibility for unintended casualties or collateral damage to unintended targets. Frangible lead-free shot, such as found in U.S. Pat. No. 9,587,918 to Burrow ("Burrow"), incorporated herein in its entirety for all purposes, can be used for the shot used in this invention.

Certain embodiments comprise shot using material as disclosed in U.S. Provisional Patent Application No. 62/573,632 to Folaron ("Folaron"), filed on Oct. 17, 2017, which is incorporated by reference herein in its entirety for all purposes. The frangible material of Folaron provides kinetic energy capable of destroying drones within 40 meters (131 feet) of deployment from the projectile. However, the frangible material of Folaron rapidly dissipates kinetic energy once beyond 40 meters (131 feet) from deployment such that is considered non-lethal in the event of contact with unintended targets. The material makeup of the payload of the present invention of this shot can be altered in view of Folaron, and other methods known to those skilled in the art to meet different use case requirements.

Certain embodiments of the present invention comprise a primer, propellant cup, fins, a mechanical timer, a segmented outer casing, and a wad loaded with frangible shot. When set to a 200-meter (656-foot) range, the round may be fired such that it travels approximately 200 meters (656 ft), prior to the shot being deployed. Upon deployment, in certain embodiments, the shot spreads in a pattern similar to that of shot deployed from a standard shotgun shell. The extended range capabilities, size of the effective impact area, combined with a larger submunition payload of this invention make it far more versatile than standard shotgun rounds, particularly in use for immobilizing drone threats.

Certain embodiments of the present invention utilize deployable fins to stabilize the round during flight and actuate a mechanical timer. The mechanical timer allows a user to programmably delay the deployment of the shot to result in an effective impact area similar to a standard shotgun shot at an increased range. This permits a user to tailor the effective range of the round to a particular use case. For instance, certain embodiments result in an effective impact area diameter of 100 cm (40 in) at a range of 40 meters (131 feet), when the mechanical timer is set to 0 meters (0 feet). Setting the mechanical timer of the same embodiment to 200 meters (656 feet), would result in a 100 cm (40 in) diameter effective impact area at a range of 240 meters (787 feet).

It is an aspect of certain embodiments to provide a delayed deployment of shot from a projectile to result in an effective impact area at an appropriate range for neutralizing a drone threat. Certain embodiments deploy the payload using a mechanical timer once the round has traveled a predetermined distance. Certain embodiments use a mechanical timer—such as disclosed by in U.S. Pat. No. 3,703,866 to Semenza ("Semenza"), incorporated herein in its entirety for all purposes—to provide the ability for a delayed deployment of shot.

Certain embodiments are designed to be integrated in existing defense networks against drones. Because embodiments of the present invention can be manufactured to be fired from existing weapon platforms, the present invention can be quickly and easily integrated into operational service. It is an aspect of the present invention to allow production of embodiments intended to be fired from existing weapons platforms such that security personnel are not encumbered with burdened with ancillary equipment related to drone threats.

Certain embodiments of the present invention are configured to be used with existing 40 mm barreled weapons and other commonly used weapons available to military and law enforcement professionals. It will be appreciated by those skilled in the art that embodiments of the present invention can be adapted to the caliber of weapons other than 40 mm weapons while in keeping with the spirit and the scope of the present invention.

Certain embodiments comprise an outer casing having three segments surrounding the leading portion of the projectile. The outer casing is typically composed of a polymeric compound such as polyethylene, but is not limited thereto. A propellant-cup contains a charge, comprising an appropriate amount of gunpowder or other accelerant with a primer for the initiation of the charge. The outer case keeps the round together as it is fired, prior to reaching the predetermined range and full deployment.

Certain embodiments comprise shot held within a shot-cup, and mechanical timer enclosed in an outer casing. External to the outer casing, a fin assembly is affixed to the trailing end of the outer casing. The fin assembly is configured to fit within the open end of a propellant cup with a wad disposed between the fin assembly and the charge. It will be appreciated by those skilled in the art that a wad surrounds a barrier which holds the powder in the bottom of the propellant and helps deploy the shot.

Upon firing, the fin assembly of certain embodiments radially expands and provides stabilization and axial rotation. The axial rotation also actuates the mechanical timer. The axial rotation of the fin assembly, spins a threaded shaft to which the fin assembly is affixed to. The threaded shaft is engaged with an aperture of a rod-puller within the outer casing, wherein the aperture comprises female threads. The rod-puller is affixed to rods which are engaged with the segments of the outer casing. In a closed-configuration, the rods retain the segments of the outer casing in place. In an open-configuration, the rods allow the segments of the outer casing to expand radially outward and separate from the projectile. Thus, when the fin assembly rotates, the rod-puller is drawn toward the trailing end of the projectile changing the projectile from a closed-configuration to an open-configuration to deploy the payload held within the shot-cup.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

BRIEF DESCRIPTION OF THE DRAWINGS

FIG. 1B—a perspective rear view of certain embodiments

DETAILED DESCRIPTION OF VARIOUS EMBODIMENTS

Figure 1A:
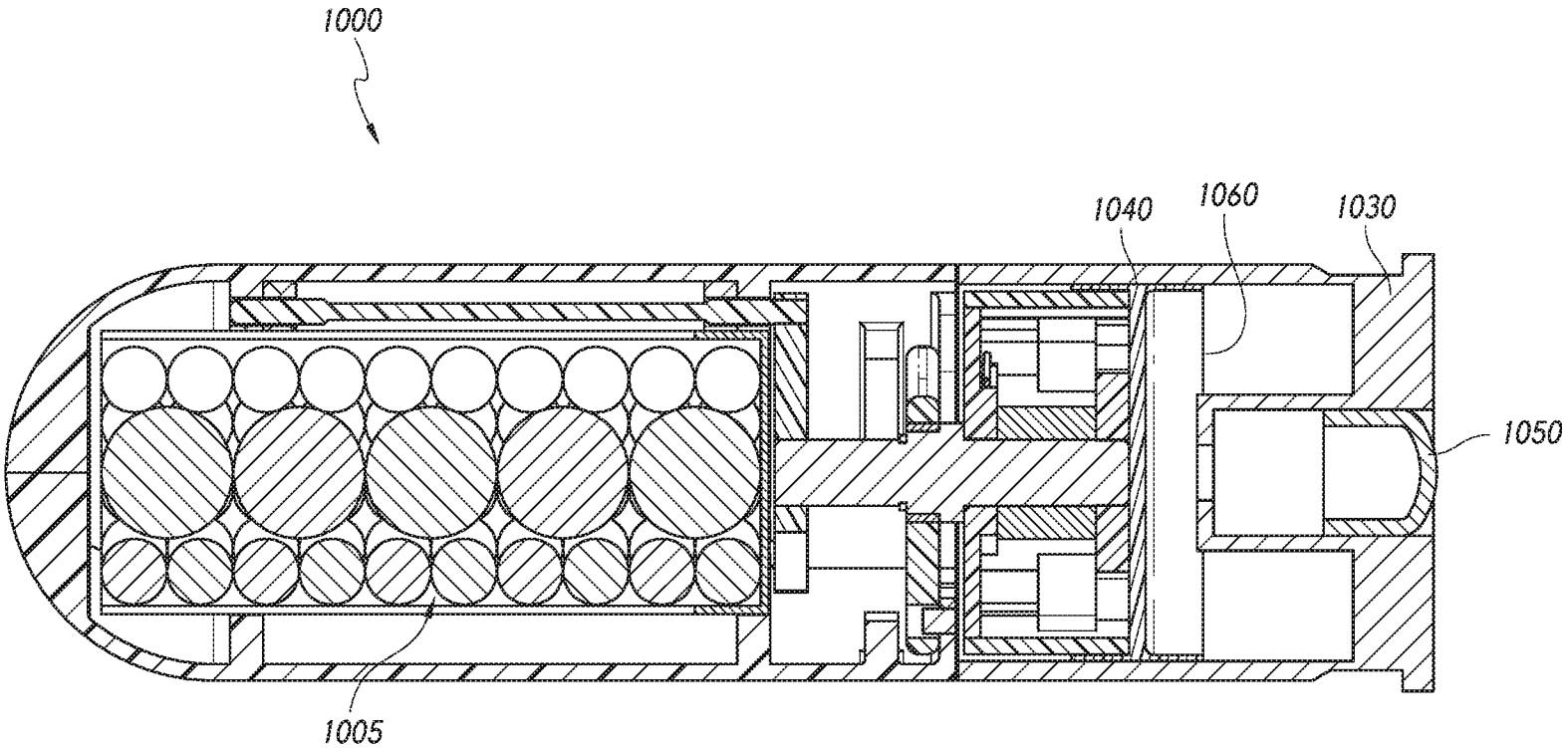
FIG. 1A—a cross-sectional side view of certain embodiments
Figure 1B:
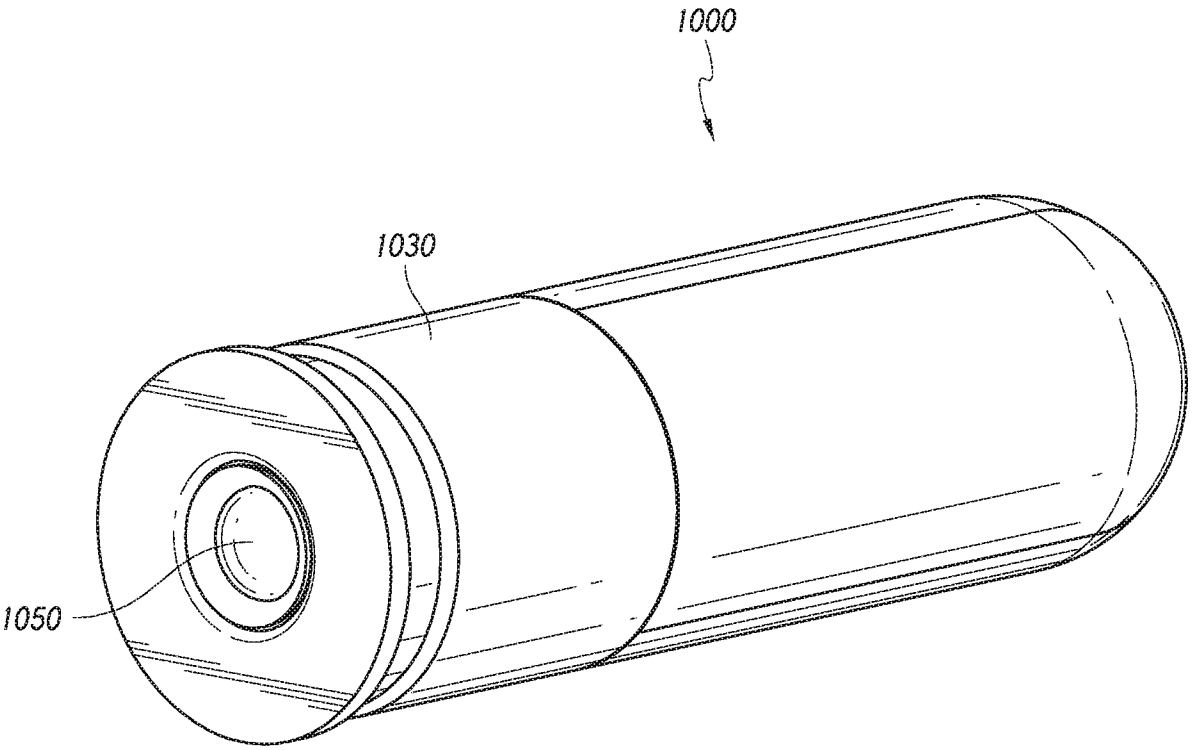

Certain embodiments comprise a projectile 1000, seen in FIG. 1A-FIG. 1B, affixed to a propellant cup 1030 with a wad 1040 therebetween. It will be appreciated by those skilled in the art that a wad, sometimes referred to as wadding, is an element used in barreled firearms to seal gas from the propellant behind a projectile, separating the charge from the projectile 1000 and transferring energy to propel the projectile 1000 and payload 1005. Wadding can be crucial to a firearm's efficiency by preventing the expanding gas from the charge from leaking past a projectile as it is being fire, ensuring that a maximum amount of energy of the charge is translated into propelling the projectile from the weapon. Wadding, as it pertains to shotgun shells, is typically a cup-shaped plastic form. It will also be appreciated by those skilled in the art that a propellant cup carries a charge of rapidly combustible material, such as gunpowder, used to propel a projectile. The propellant cup 1030 of certain embodiments further comprises a primer 1050, used to initiate a charge 1060. The initiation of the charge 1060 causes rapid combustion which results in rapid pressure increase between the wad 1040 and the propellant cup 1030, separating the projectile 1000 from the propellant cup 1030, and propelling the projectile 1000 from the weapon. Once the projectile 1000 leaves the barrel of the weapon, the wad 1040 falls away from the projectile 1000.

It will be appreciated by those skilled in the art that although a projectile traditionally uses combustible material to fire a projectile from a weapon, a projectile may be alternatively fired using other means known to those skilled in the art while in keeping with the scope and spirit of the present application. Such alternatives include, but are not limited to, electromagnetic propulsion and pneumatic propulsion.

Figure 2A:
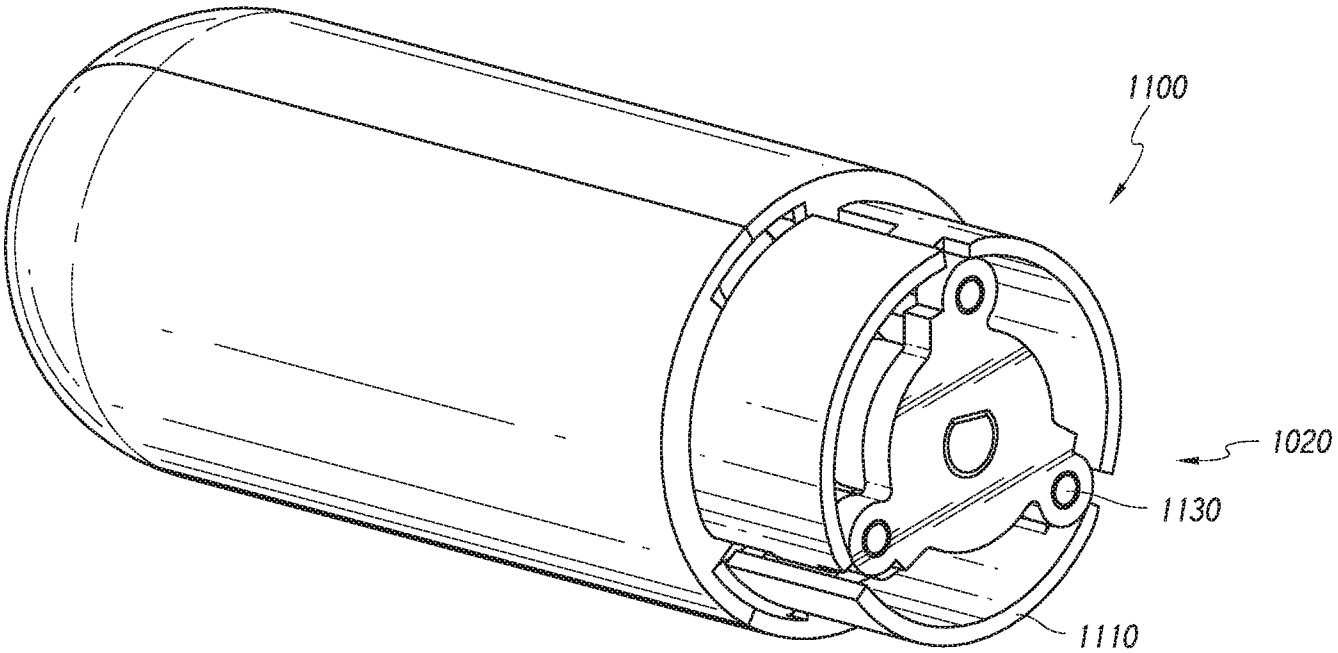
FIG. 2A—a perspective rear view of certain embodiments showing undeployed fin assembly FIG. 2B—a perspective rear view of certain embodiments showing deployed fin assembly FIG. 3A—a perspective front view of an undeployed fin assembly of certain embodiments FIG. 3B—a front view of an undeployed fin assembly of certain embodiments FIG. 3C—a perspective rear view of a deployed fin assembly of certain embodiments FIG. 3D—a front view of a deployed fin assembly of certain embodiments FIG. 4—a perspective view of certain embodiments having a deployed fin assembly FIG. 5A—front perspective view of a deployed fin assembly of certain embodiments FIG. 5B—rear perspective view of a deployed fin assembly of certain embodiments FIG. 6—exploded perspective view of certain embodiments FIG. 7—a cross-sectional side view of certain embodiments FIG. 8A—perspective side view of certain embodiments showing a closed-configuration FIG. 8B—perspective side view of certain embodiments showing an open-configuration FIG. 9—side view of a rod of certain embodiments FIG. 10A—section view of certain embodiments FIG. 10B—section view of certain embodiments FIG. 11—exploded perspective view of certain embodiments
Figure 2B:
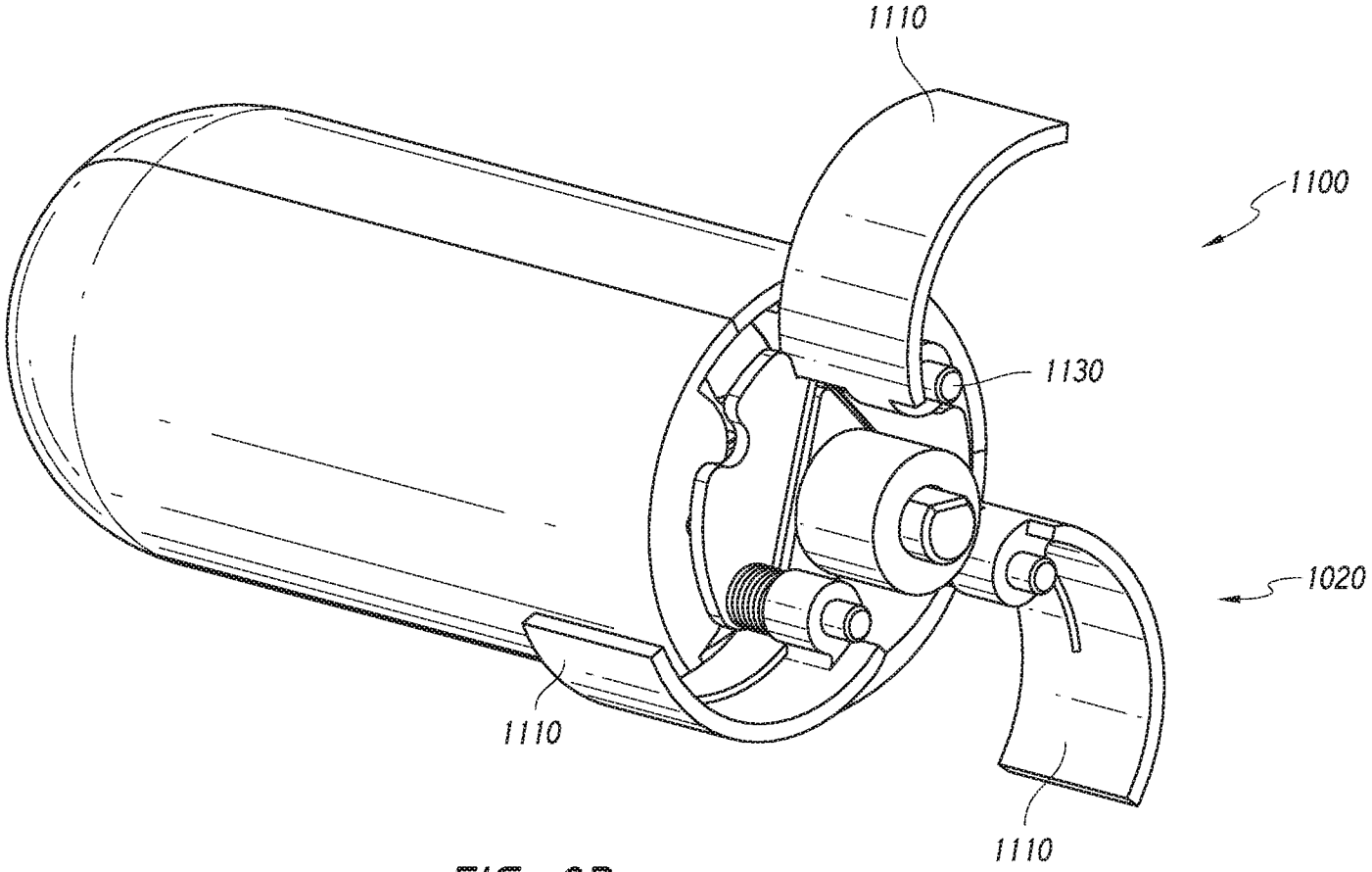
Figure 3A:
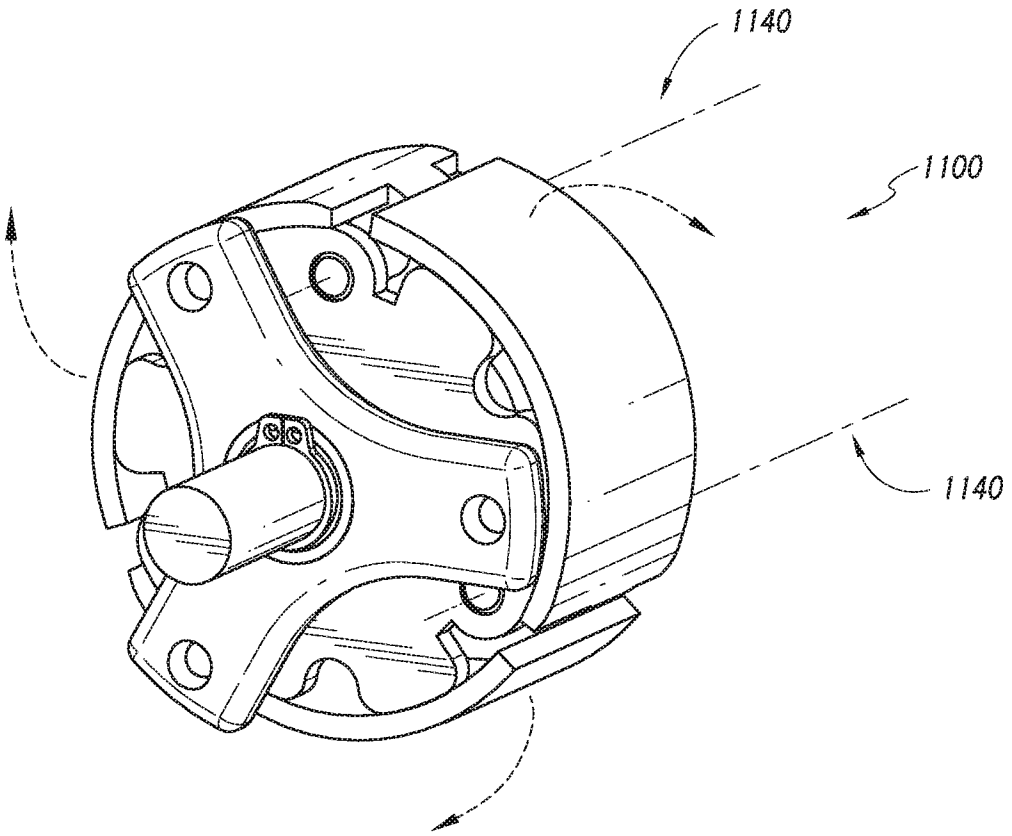
Figure 3B:
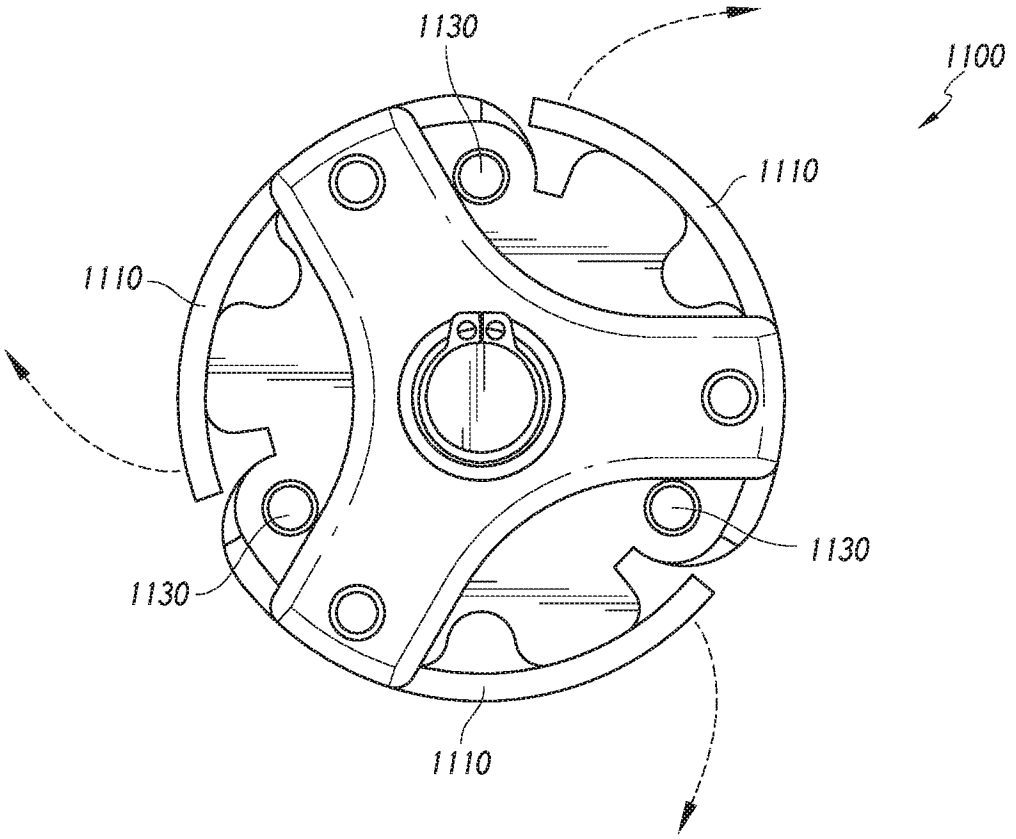
Figure 3C:
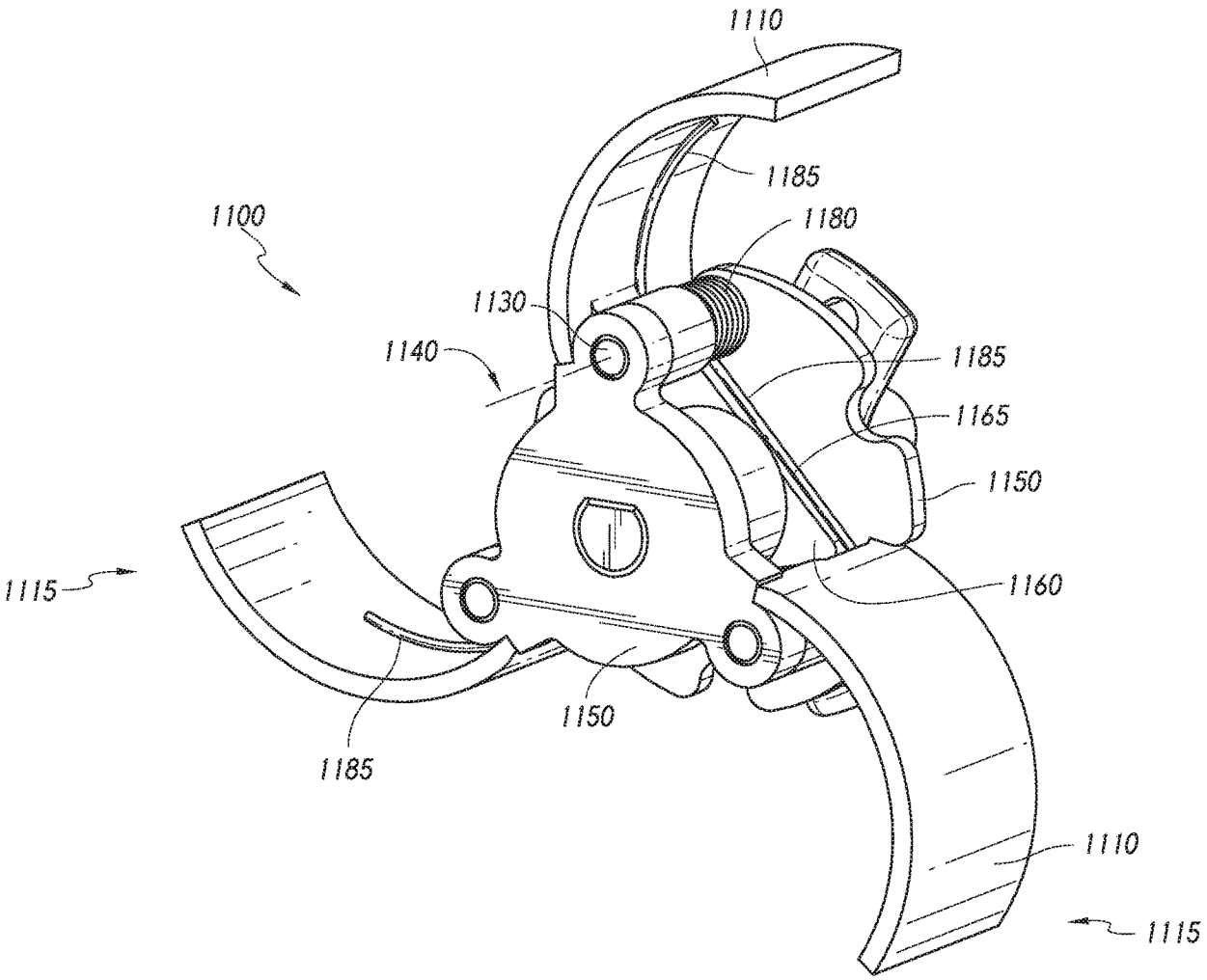
Figure 3D:
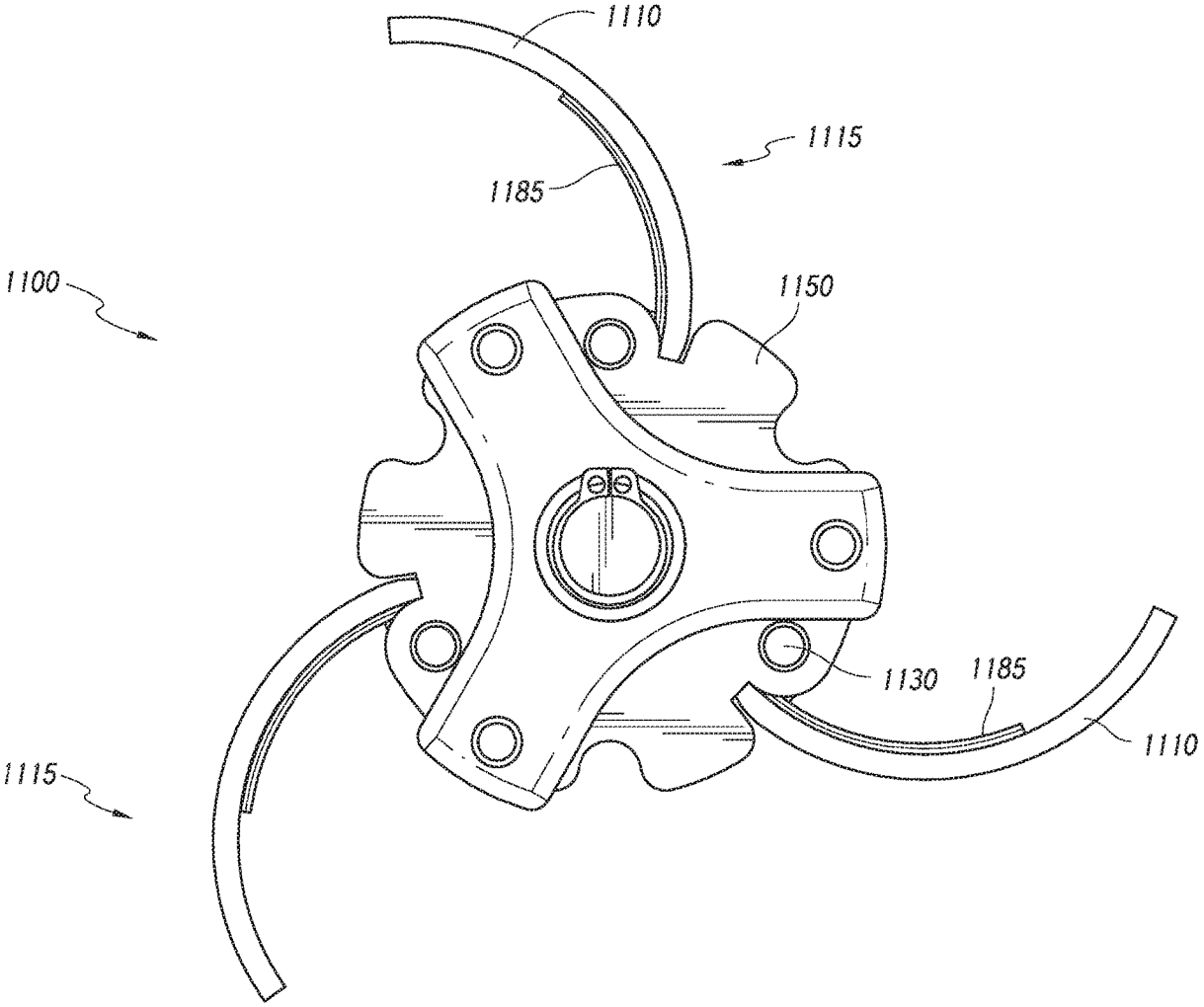

In certain embodiments, shown in FIG. 2A-FIG. 2B, a projectile 1000 comprises a fin assembly 1100 comprising fins 1110 for the stabilization of the projectile 1000 while in flight. Certain embodiments comprise radially deployable fins 1110 which rotate radially outward from the projectile 1000 once the projectile leaves the barrel of the weapon from which it is fired. Certain embodiments comprise radially deployable fins 1110 which are affixed proximate to the trailing end 1020 of the projectile 1000 using a pinned connection 1130.

A fin 1110, in certain embodiments (FIG. 3A-FIG. 3D), rotates radially outward about the central axis 1140 of a pinned connection 1130. In certain embodiments, a fin 1110 is fixated to the fin assembly 1100 through a pinned connection 1130 between a first fin mount 1150 and a second fin mount 1150. A fin mount of certain embodiments comprises a boss 1160, providing a mechanical stop 1165 for a spring 1180. In embodiments comprising a torsional spring 1180, a first leg 1185 of the spring 1180 bears on the fin 1110, and a second leg 1185 of the spring 1180 bears on the mechanical stop 1165, thus applying a force to rotate the fin 1110 radially outward from the projectile 1000.

Figure 4:
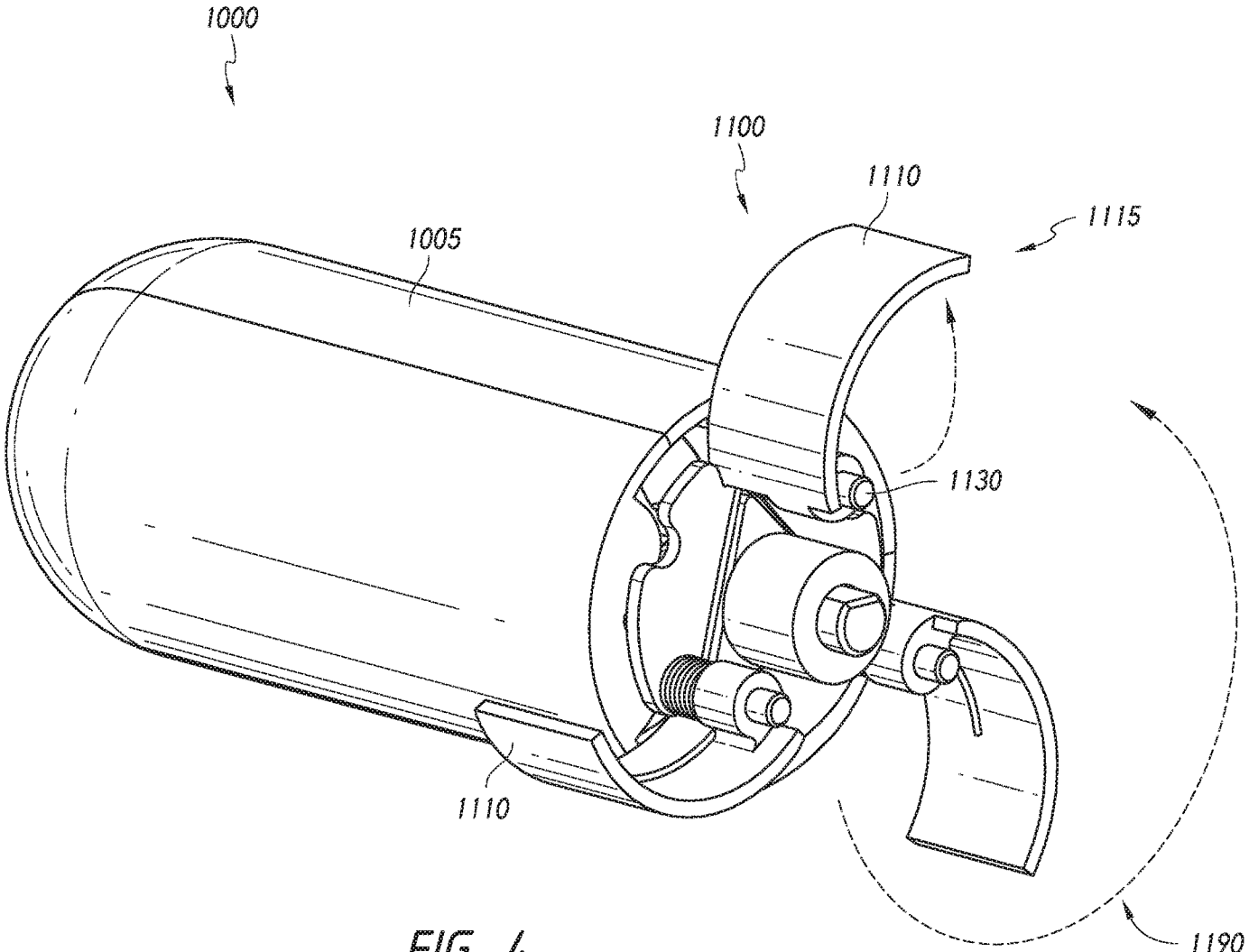

When the projectile 1000 (FIG. 4) leaves the barrel of a weapon, the fin 1110 is forced radially outward to a deployed position 1115 to provide stabilization. Certain embodiments of a fin 1110 are configured to induce radial rotation 1190 to the fin assembly 1100 in relation to the outer casing 1005. It will be appreciated that such radial rotation 1190 provides increased stabilization. It will be further appreciated that certain embodiments of a fin assembly 1100 may be configured to rotate clockwise or counter-clockwise rotation, while in keeping with the spirit and scope of the present invention.

Figure 5B:
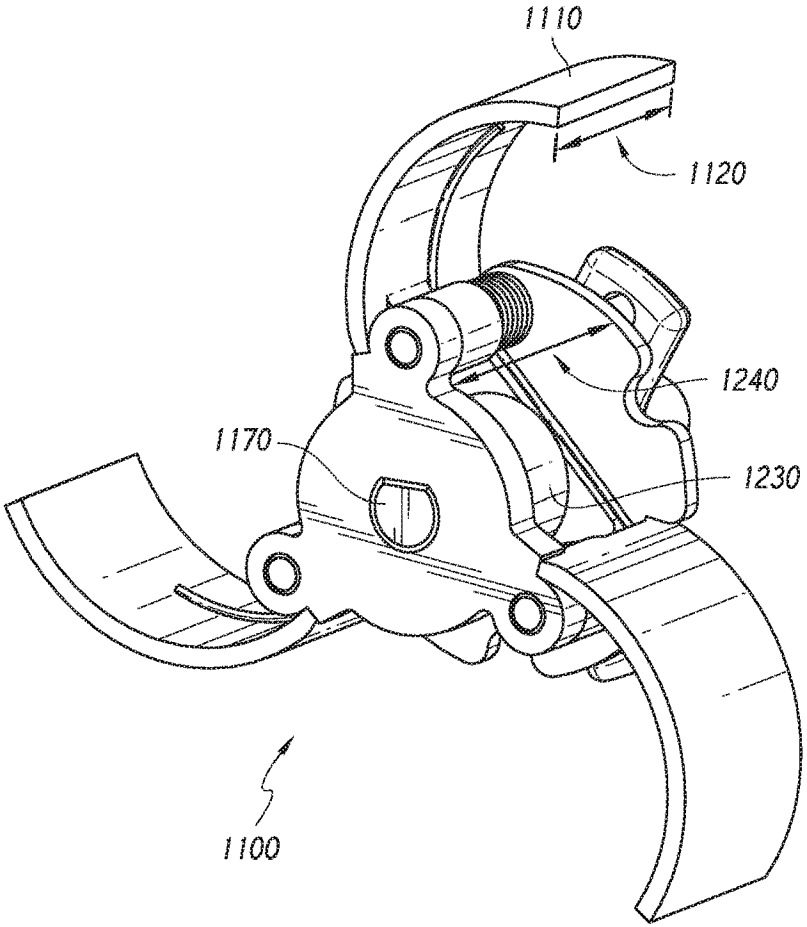
Figure 5A:
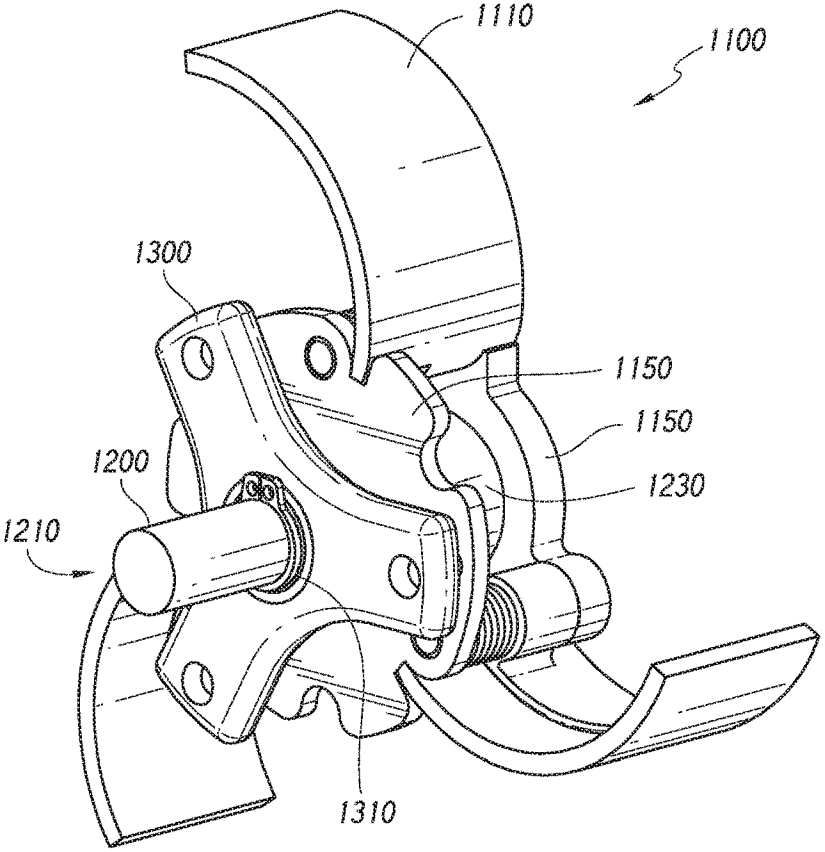

In certain embodiments, shown in FIG. 5A-FIG. 5B, the fin mounts 1150 are affixed to a threaded shaft 1200. In certain embodiments, the fin mounts 1150 comprise an aperture 1170. The aperture 1170 is keyed and configure to mate with the threaded shaft, to limit radial rotation of the fin assembly 1100 in relation to the threaded shaft 1200. The threaded shaft 1200 passes through apertures 1170 of the fin mounts, and a bushing 1230 disposed between a first fin mount 1150 and a second fin mount 1150. The bushing 1230 is configured to allow the retention of the fins 1110 between a first fin mount 1150 and a second fin mount 1150 without compression of the fins 1110 between the fin mounts 1150. Compression of the fins 1110 between the fin mounts 1150 would result in binding, thus restricting the fins from rotating radially outward. In certain embodiments, the distance 1240 between fin mounts 1150 is greater than the height 1120 of a fin.

Figure 6:
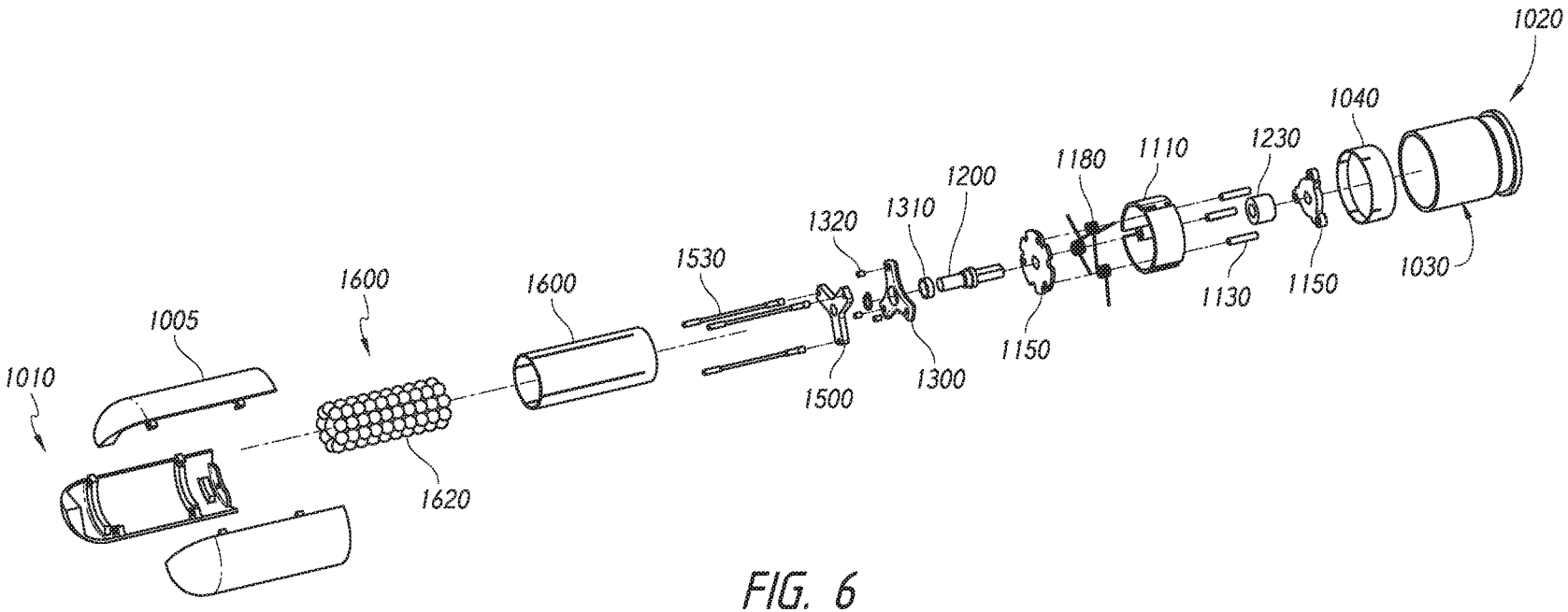
Figure 7:
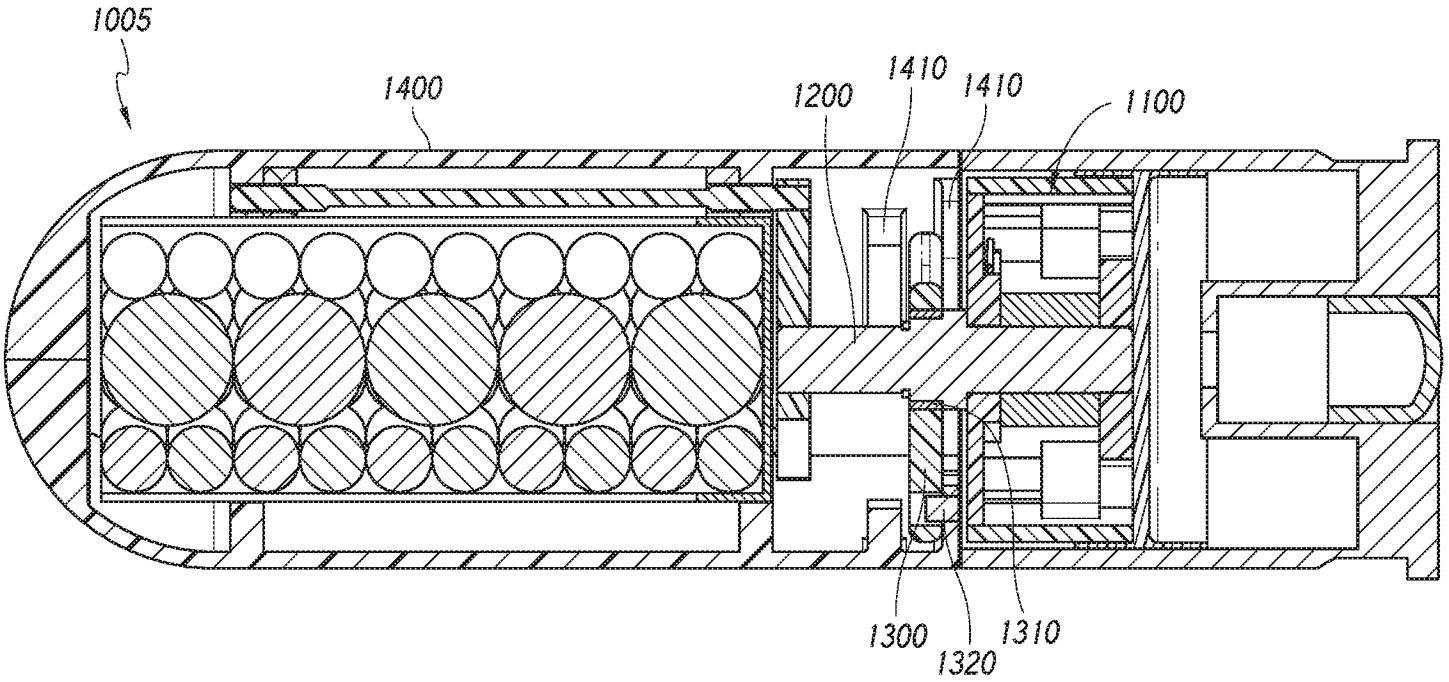

In certain embodiments, shown in FIG. 5A-FIG. 5B, a portion of the threaded shaft 1200 extends away from the fin assembly 1100, axially within the projectile 1000, toward the leading end 1010 of the projectile. A bearing 1310 interfaces between a portion of the threaded shaft 1200 and a retainer 1300. It will be appreciated that a bearing 1310, as used herein, surrounds a mechanical element configured to allow axial rotation with limited frictional interference. A bearing 1310 as used herein includes, but is not limited to a plain bearing, a rolling-element bearing, ball-bearing, roller-bearing, fluid bearing, jewel bearing, and a sleeve bearing—while in keeping with the spirit and scope of the present invention. A retainer 1300 of certain embodiments is referred to as an impeller. The retainer 1300 of certain embodiments comprises a mechanical stop 1320, referencing FIG. 6-FIG. 7, configured to abut a first mechanical stop 1410 of a segment of the outer casing, extending inward from the segment 1400 of an outer casing 1005, thereby limiting the rotation of the retainer 1300 in relation to the outer casing 1005. In certain embodiments, a segment 1400 of outer casing further comprises a second mechanical stop 1410. Furthermore, rotation induced by the fin assembly 1100, rotates the fin assembly 1100 in relation to the outer casing 1005. It will be appreciated that, due to the higher mass associated with some payloads—such as shot—contained within the outer casing 1005, the fin assembly 1100 of certain embodiments will axially rotate faster than the outer casing 1005.

Figures 8A, 8B:
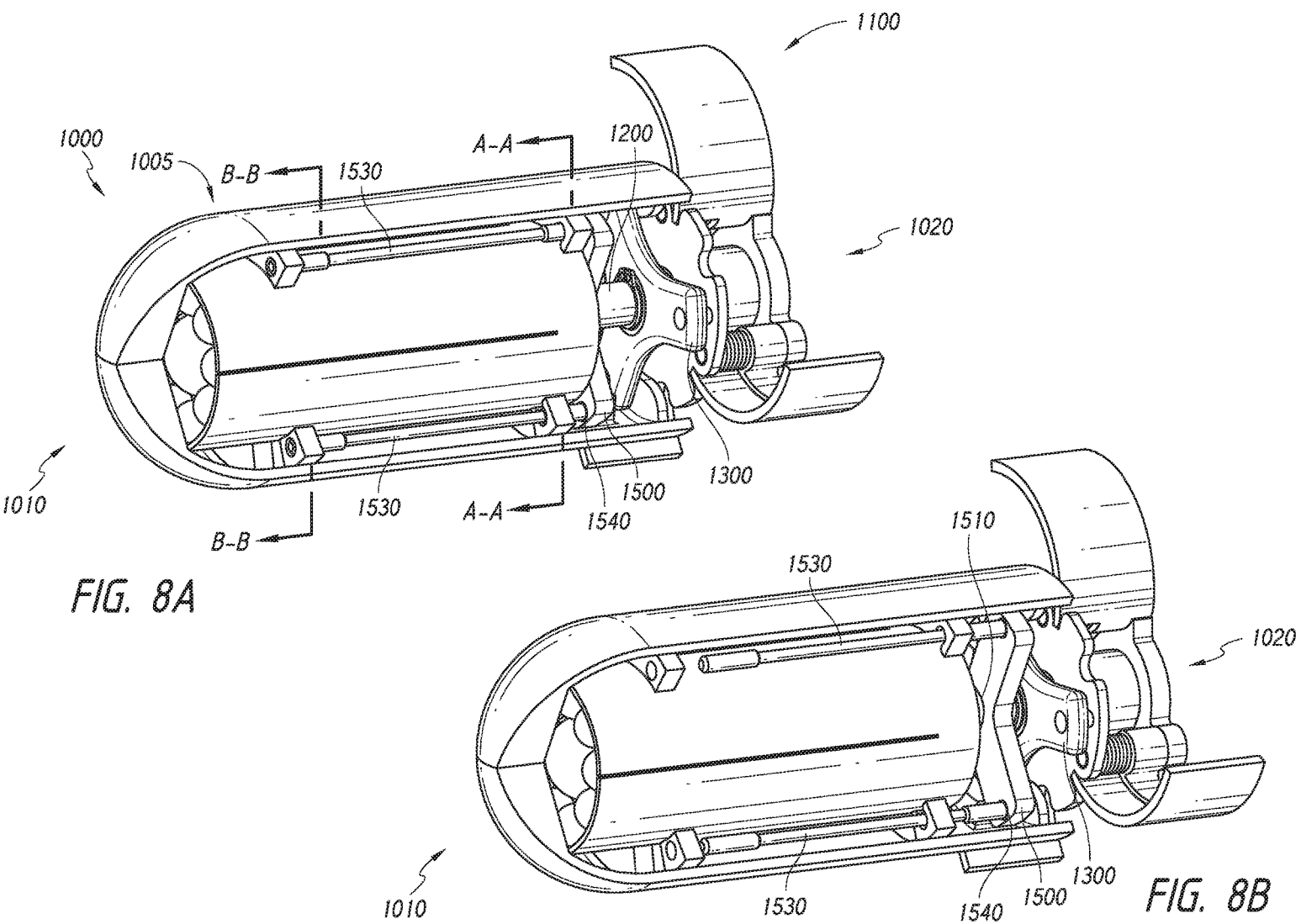

In certain embodiments, as seen in FIG. 8A-FIG. 8B, a leading end 1210 (FIG. 5A) of a threaded shaft is affixed to a rod-puller 1500. An aperture 1510 of the rod-puller, typically central to the rod-puller 1500, comprises female threading 1520 (not shown) configured to engage with the threaded shaft 1200, and a plurality of rods 1530 radially offset from the aperture 1510, and affixed to the rod-puller 1500. The rod-puller 1500 is engaged with a portion of the leading end 1210 of the threaded shaft. In certain embodiments, the rods 1530 are affixed to the rod-puller 1500 by way of mechanical interference fit, with rod-apertures 1540 in the rod-puller, radially offset from a centrally located aperture 1510 of the rod-puller.

Figure 9:
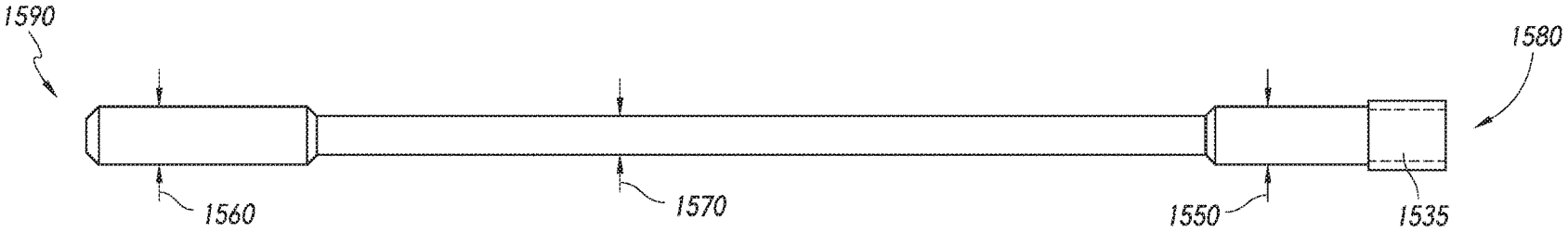
Figure 10B:
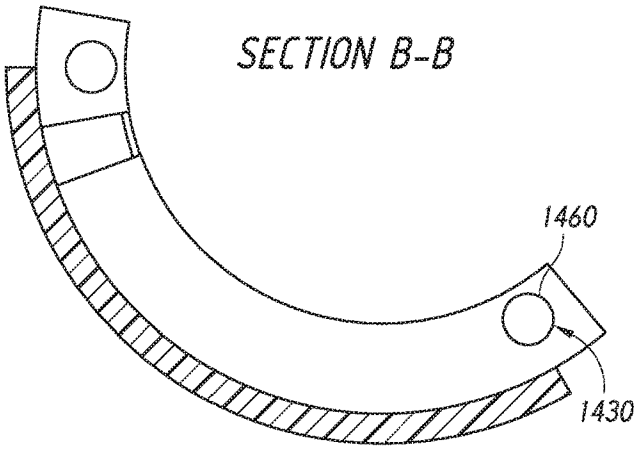
Figure 10A:
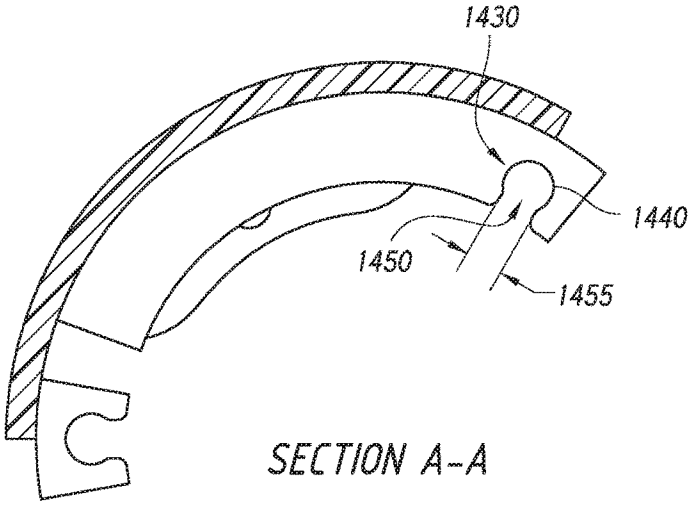

In certain embodiments, seen in FIG. 8A-FIG. 9, the rods 1530 further comprise a threaded end 1535 for engagement with rod-apertures 1540 in the rod-puller. In certain embodiments, the rod-puller 1500 comprises three rod-apertures 1540 which are equally offset from a centrally located aperture 1510, and radially spaced at 120-degree increments. When the fin assembly 1100 rotates in relation to the outer casing 1005, the threaded shaft 1200 is advanced further into the aperture 1510 of the rod-puller, thereby drawing the rod-puller 1500 rearward toward the fin assembly 1100. It will be appreciated that although embodiments described surround a rod-puller 1500 being drawn toward the trailing end 1020 of the projectile, a rod-puller 1500 of certain embodiments can be advanced toward the leading end 1010 of the projectile in efforts to pull or push rods 1530 to release segments 1400 of the outer casing. It will be appreciated by those skilled in the art, that the delay of deployment of payload 1610 (FIG. 6) of the present invention can be altered through the modification of one or more features. For instance, the modification of the thread pitch of the threaded shaft 1200 to comprise a coarse thread would actuate the rod-puller 1500 into an open-configuration more rapidly than a threaded shaft having a fine thread.

In certain embodiments, shown in FIG. 8A-8B, the actuation of a rod-puller 1500 results in drawing the rod-puller 1500 rearward toward the trailing end 1020 of the projectile. A plurality of rods 1530 having a first end 1580 affixed to the rod-puller 1500, extend toward the leading end 1010 of the projectile from the rod-puller 1500, substantially parallel to the central axis 1090 of the projectile. When the projectile 1000 is in a closed-configuration (FIG. 8A), the rods engage with retaining features affixed to the interior surface of the segments of the outer casing. When the rod-puller 1500 is actuated, placing the projectile 1000 in an open-configuration (FIG. 8B), the rods 1530 release from retaining features 1430 on an internal aspect of the segments of the outer casing.

In certain embodiments, referencing FIG. 8A-10B, a rod 1530 comprises a first diameter 1550 consistent with a first end 1580 of the rod, a second diameter 1560 consistent with a second end 1590 of the rod, and a third diameter 1570 located between the first diameter 1550 and the second diameter 1560. A first retaining feature 1430 of a segment has a groove 1440 having a substantially circular cross section configured to retain the first diameter 1550 of the rod, and the groove 1440 having a lateral opening 1450 with a width 1455 smaller than the first diameter 1550 of the rod and larger than the third diameter 1570. The second diameter 1560 of a rod engages with a second retaining feature 1430 comprising an aperture 1460 having a substantially circular cross section. Thus, when the rod-puller 1500 draws the rods 1530 rearward toward the trailing end 1020 of the projectile, the first diameter 1550 disengages from the first retaining feature 1430 and the second diameter 1560 disengages from the second retainer feature 1430. The third diameter 1570, now aligned with the first retainer feature 1430, is configured to pass through the lateral opening 1450 of the groove. Thus, the projectile transitions from a closed-configuration (FIG. 8A), to an open-configuration, and a segment 1400 of the outer casing is permitted to expand and release radially outward, separating from the projectile 1000.

Figure 11:
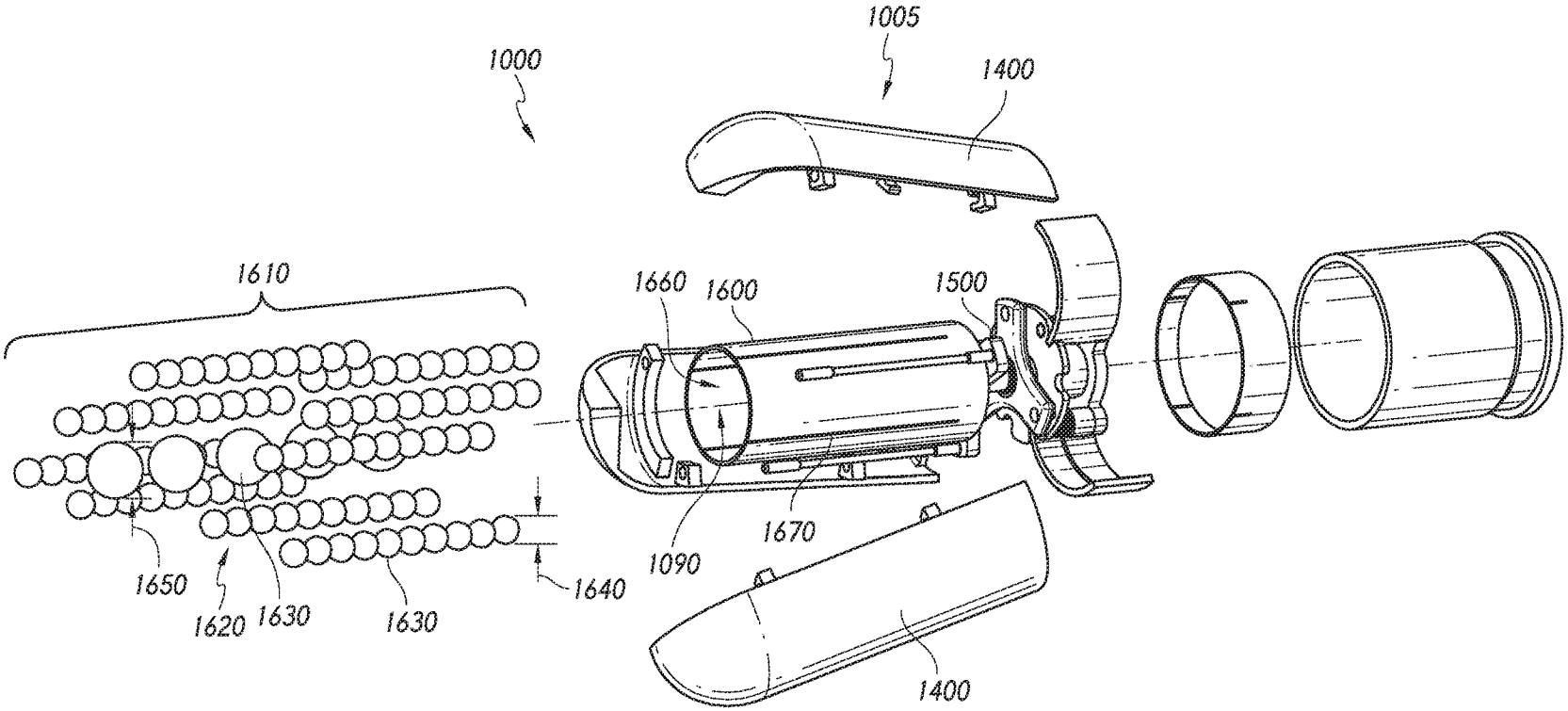

The projectile of certain embodiments, as seen in FIG. 11, comprises an outer casing 1005 having a plurality of segments 1400 surrounding a payload 1610. The actuation of a retaining mechanism, such as a rod-puller 1500, configures the retaining mechanism from a closed-configuration as shown in FIG. 8A, to an open-configuration as shown in FIG. 8B, releasing the segments 1400 of the outer casing. Thus, in flight, the segments 1400 of the outer casing are released, and permitted to expand radially outward from a central axis 1090 of the projectile. Upon the radial expansion of the outer casing 1005, from the central axis 1090 of the projectile, the segments 1400 create aerodynamic drag. Thus, the segments separate from the projectile, and the shot 1620—having a higher inertial mass and lower aerodynamic drag than the segments 1400 and shot-cup 1600—separates from the projectile 1000 for final deployment toward an intended target.

The payload 1610 of certain embodiments, as seen in FIG. 11, comprises shot 1620 having a first pellet 1630 having a first diameter 1640, and a second pellet 1630 having a second diameter 1650. It will be appreciated that different size of pellets 1630 used in the same payload 1610 allows the tailoring of effective impact area of the pellets 1630. It will be appreciated by those skilled in the art that a pellet of a larger diameter will spread outward less than a pellet of smaller diameter. Thus, the smaller diameter pellets will spread outward from path of the projectile 1000 more than the pellets of larger diameter. It will be further appreciated by those skilled in the art that although the fin assembly 1100 axially rotates in relation to the outer casing 1005, the outer casing 1005 of certain embodiments also axially rotates, thus the payload 1610 also rotates axially. Due to axial rotation, the rotational inertia of the pellets 1630 of shot further induce an outward spread of pellets 1630.

In certain embodiments the shot-cup 1600 is packed with shot 1620 having pellets 1630 of two different diameters: 6.35 mm (0.25 in) and 12.7 mm (0.5 in). The different diameter pellets 1630, typically in spherical form, allow for a wider dispersal and thus a larger effective impact area. It will be appreciated that embodiments can comprise pellets 1630 of different diameters than disclosed herein without departing from the spirit of scope of the present invention. Certain embodiments of the shot 1620 comprise a lead-free frangible material. The frangible and low-density nature of the shot 1620 allows it to dissipate enough kinetic energy in the event the shot 1620 does not strike an intended target. The shot-cup 1600, of certain embodiments, comprises a cylinder with an open end 1660, and a plurality of slits 1670 cut along its length. As the shot 1620 is released from the shot-cup 1600, it is deployed normally, as if fired from a standard shotgun.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A projectile comprising:

a longitudinal axis;

a fin assembly at a trailing end of the projectile;

the fin assembly comprising a plurality of fins, the fins distributed around a first fin mount, the fins having a connection to the first fin mount wherein the fins are radially deployable;

a first end of a shaft disposed through an aperture of the first fin mount, and extending away from the fin assembly toward a leading end of the projectile;

the leading end of the projectile comprising a plurality of segments forming an outer casing; and a payload comprising shot pellets constrained within the outer casing, wherein the plurality of segments are configured to separate, thereby opening the outer casing, and thereby releasing the payload from the projectile.

2. The projectile of claim 1 further comprising:

a central axis;

threading on the shaft;

a rod-puller located between the fin assembly and the payload, the rod-puller comprising an aperture wherethrough the shaft extends through, and a plurality of rods radially offset from the aperture of the rod-puller;

the aperture of the rod-puller comprising female threading configured to mate with the threading of the shaft;

the rods having a first end affixed to the rod-puller, and a second end extending toward the leading end of the projectile; and each segment having a retaining feature comprising an opening configured to mate with one of the rods, wherein the projectile begins in a closed-configuration with the rods mated with the retaining features of the segments, and wherein the fins are configured to induce axial rotation to the fin assembly, thereby rotating the shaft, thereby moving the rod-puller along the central axis and disengaging the rods from the retaining features, thus changing the projectile from a closed-configuration to an open-configuration.

3. The projectile of claim 2 wherein;

the rods have a diameter;

the segments of the outer casing each having a retaining feature comprising an aperture with a diameter greater than the diameter of the rods; and wherein the rods are aligned with the retaining features in a closed configuration, and wherein the rods are retracted from the retaining features in an open configuration.

4. The projectile of claim 2 wherein;

the rods have a first diameter and a second diameter which is less than the first diameter;

the segments of the outer casing each having a first retaining feature having a groove with a diameter equal or greater than the first diameter of the rod; and the groove having a lateral opening width less than the first diameter of the rods and greater than the second diameter of the rods, wherein, for each rod, the first diameter is aligned with a corresponding one of the first retaining features in a closed configuration and the second diameter is aligned with the corresponding one of the first retaining features in an open configuration.

5. The projectile of claim 2 wherein;

the rods have a first diameter at the first end of the rod, a second diameter at the second end of the rod, and a third diameter between the first diameter and the second diameter;

the third diameter being smaller than the first diameter;

the segments of the outer casing each having a first retaining feature having a groove with a diameter greater than the first diameter of the rods and a second retaining feature having an aperture with a diameter greater than the second diameter of the rods;

the groove having a lateral opening width less than the first diameter of the rods and greater than the third diameter of the rods, wherein, for each rod, the first diameter is aligned with a corresponding one of the first retaining features and the second diameter is aligned with a corresponding one of the second retaining features in a closed configuration, and wherein, for each rod, the third diameter is aligned with the corresponding one of the first retaining features and the second diameter is retracted from the corresponding one of the second retaining features in an open configuration.

6. The projectile of claim 2, further comprising a retainer disposed between the fin assembly and the rod-puller;

the retainer comprising an aperture with a bearing mounted therethrough; and the bearing having an aperture through which the shaft passes through, wherein the retainer remains rotationally static in relation to the outer casing.

7. The projectile of claim 2, further comprising a shot cup comprising a shot-cup configured to constrain the shot pellets within the outer casing prior to deployment.

8. The projectile of claim 7, wherein a closed trailing end of the shot-cup is affixed to a leading end of the shaft; and a leading end of the shot-cup comprises an open end, wherein rotation of the threaded shaft results in an outward spread of the pellets.

9. The projectile of claim 2, further comprising a propellant cup and wadding;

the wadding, having a cup-shaped form surrounding the fin assembly;

and the propellant cup surrounding the fin assembly and the wadding.

10. The projectile of claim 1, wherein the fins are attached to the first fin mount with a pinned connection.

11. The projectile of claim 10, further comprising a second fin mount wherein the fins are mounted between the first fin mount and the second fin mount.

12. The projectile of claim 11, further comprising torsional springs wherein a first leg of the torsional springs bears on a portion of the first fin mount, and a second leg of the torsional springs bear on the fins, wherein the torsional springs apply a force to rotate the fins radially outward from the projectile.

13. The projectile of claim 12, further comprising a bushing disposed between the first fin mount and the second fin mount;

the bushing having a height configured to offset the first fin mount from the second fin mount by a distance greater than a height of the fins.

14. The projectile of claim 1, wherein the shot pellets comprise first pellets and second pellets, wherein the second pellets are larger than the first pellets.

15. The projectile of claim 14, further comprising:

a second fin mount wherein the fins are mounted between the first fin mount and the second fin mount;

torsional springs wherein a first leg of the torsional springs bear on a portion of the first fin mount, and a second leg of the torsional springs bear on the fins, wherein the torsional springs apply a force to rotate the fins radially outward from the projectile.

16. The projectile of claim 15, wherein the payload comprises a cylindrical form having axially located second pellets surrounded by first pellets.

17. An anti-drone projectile comprising:

a fin assembly having three radially expandable fins having a pinned connection to a first fin mount and a second fin mount;

the fins having a torsional spring with a first leg configured to apply force against the fins radially outward, and a second leg of the torsional spring bearing on a boss of the second fin mount;

a bushing disposed between the first fin mount and the second fin mount, the bushing having a height greater than a height of the fins;

a first end of a threaded shaft disposed through a central aperture of the first fin mount, through the bushing, through a central aperture of the second fin mount and extending away from the fin assembly toward a leading end of an outer casing;

a retainer having a central aperture disposed around the threaded shaft proximate to a trailing end of the outer casing and a sleeve bearing disposed between the threaded shaft and the retainer;

a rod-puller having a central aperture having female threads configured to mate with the threaded shaft, the central aperture of the rod-puller engaged with a portion of a leading end of the threaded shaft;

a shot-cup having a payload comprising shot pellets, the shot-cup affixed to a second end of the threaded shaft;

the shot pellets comprising first pellets having a first diameter, and second pellets having a second diameter, wherein the second pellets are larger than the first pellets;

the rod-puller further comprising three rod-apertures radially offset equally from the central aperture at 120-degree increments;

three rods each having a first end affixed to a corresponding one of the rod-apertures of the rod-puller;

the rods having a first diameter consistent with a first end thereof, a second diameter consistent with a second end thereof, and a third diameter therebetween;

the third diameter of the rods being less than the second diameter and the first diameter of the rods;

the outer casing comprising segment each having a first retaining feature having a circular groove with a diameter greater than the first diameter of the rods, the groove having a lateral opening with a width less than the first diameter of the rods and greater than the third diameter of the rods;

each segment of the outer casing having a second retaining feature having a circular aperture having a diameter greater than the second diameter of the rods; and a leading end of the segments of the outer casing configured to comprise a hemispherical form, wherein the fins are configured to induce axial rotation to the fin assembly, thereby rotating the threaded shaft, which draws the rod-puller toward the fin assembly to disengage the rods from the retaining features, thereby allowing the segments of the outer casing to expand radially outward to deploy the payload.

* * * * *